US011919673B2

(12) United States Patent
Austin et al.

(10) Patent No.: US 11,919,673 B2
(45) Date of Patent: Mar. 5, 2024

(54) LIFT VAN

(71) Applicants: Matthew James Austin, Seekonk, MA (US); Chad Colin Cash, North Attleboro, MA (US)

(72) Inventors: Matthew James Austin, Seekonk, MA (US); Chad Colin Cash, North Attleboro, MA (US)

( * ) Notice: Subject to any disclaimer, the term of this patent is extended or adjusted under 35 U.S.C. 154(b) by 0 days.

(21) Appl. No.: 17/730,340

(22) Filed: Apr. 27, 2022

(65) Prior Publication Data

US 2022/0348380 A1 Nov. 3, 2022

Related U.S. Application Data

(60) Provisional application No. 63/181,499, filed on Apr. 29, 2021.

(51) Int. Cl.
*B65D 21/02* (2006.01)
*B65D 21/08* (2006.01)

(52) U.S. Cl.
CPC ..... *B65D 21/0223* (2013.01); *B65D 21/086* (2013.01)

(58) Field of Classification Search
CPC ..... B65D 21/0223; B65D 21/086; B65D 2203/10; B65D 2519/00034; B65D 2519/00069; B65D 2519/00174; B65D 2519/00208; B65D 2519/00268; B65D 2519/00288; B65D 2519/00318; B65D 2519/00338; B65D 2519/00497; B65D 2519/00587; B65D 2519/00641; B65D 2519/00661; B65D 2519/00711; B65D 2519/00781; B65D 2519/00975; B65D 19/18; B65D 88/005
See application file for complete search history.

(56) References Cited

U.S. PATENT DOCUMENTS 6,227,397 B1 * 5/2001 Kim ..... B65D 88/121 220/8
2014/0197168 A1 * 7/2014 Miller ..... B65D 88/528 220/4.33

* cited by examiner

*Primary Examiner* — Andrew D Perreault
(74) *Attorney, Agent, or Firm* — Bachman & LaPointe, P.C.

(57) ABSTRACT

A lift van crate formed as a rectilinear shaped compartment formed by a base; a first long wall having tabbed edges and a second long wall having tabbed edges, mounted to said base; a first short wall having tabbed edges and a second short wall having tabbed edges, mounted to said base, said first short wall and said second short wall having short wall receivers configured to receive at least one long wall interior tab of each of said respective adjacent first long wall and second long wall; a lid having an interior face and an exterior face, at least one lid receiver formed in said lid interior face, said lid configured to mount to each of said first long wall, second long wall, first short wall and said second short wall respectively by insertion of said tabbed edges into said at least one lid receiver.

19 Claims, 6 Drawing Sheets

LIFT VAN

CROSS-REFERENCE TO RELATED APPLICATION

This application claims the benefit of provisional application Ser. No. 63/181,499, filed Apr. 29, 2021.

BACKGROUND

The present disclosure is directed to a lift van crate, particularly a lift van crate configured to be disassembled and reassembled and constructed of durable materials.

The lift van crate is the most common form of shipment crate for household goods. The term "lift van" is used because a fork lift is used to lift the crate onto the moving van. Lift vans are used to ship goods all over the world because the lift van's unique dimensions make them ideal for standard 20 foot and 40 foot shipping containers. The lift van is currently offered in two forms of material, chemically treated wood or corrugated paper material. Neither are suitable for multiple uses. Neither can be deconstructed for storage and reliable reuse. Neither are eco-friendly.

SUMMARY

In accordance with the present disclosure, there is provided a lift van crate comprising a base having an interior face and an exterior face opposite the interior face, at least one receiver formed in the interior face; a first long wall having tabbed edges and a second long wall having tabbed edges, the tabbed edges of the first long wall and the tabbed edges of the second long wall each being configured to mount to the at least one receiver of the base adjacent the interior face; a first short wall having tabbed edges and a second short wall having tabbed edges, the tabbed edges of the first short wall and the tabbed edges of the second short wall each being configured to mount to the at least one receiver of the base adjacent the interior face, the first short wall and the second short wall having short wall receivers configured to receive at least one long wall interior tab of each of the respective adjacent first long wall and second long wall; and a lid having an interior face and an exterior face, at least one lid receiver formed in the lid interior face, the lid configured to mount to each of the first long wall, second long wall, first short wall and the second short wall respectively by insertion of the tabbed edges into the at least one lid receiver, wherein a rectilinear shaped compartment is formed.

A further embodiment of any of the foregoing embodiments may additionally and/or alternatively include the base includes at least one channel formed in the exterior face and feet formed in the exterior face adjacent the at least one channel.

A further embodiment of any of the foregoing embodiments may additionally and/or alternatively include the feet comprise at least one flared surface.

A further embodiment of any of the foregoing embodiments may additionally and/or alternatively include the feet comprise at least one bearing feature mounted within the feet.

A further embodiment of any of the foregoing embodiments may additionally and/or alternatively include the lift van crate further comprising at least one ridge formed in the exterior surface of the lid, the at least one ridge being insertable into the at least one channel of the base between the feet, wherein the base exterior surface being configured to nest with the lid for stacking the lift van crate onto another lift van crate.

A further embodiment of any of the foregoing embodiments may additionally and/or alternatively include at least one of the first long wall and the second long wall comprise an adjustable tab configured to be retracted and extended.

A further embodiment of any of the foregoing embodiments may additionally and/or alternatively include at least one of the first short wall and the second short wall comprise an adjustable tab configured to be retracted and extended.

A further embodiment of any of the foregoing embodiments may additionally and/or alternatively include the lift van crate further comprising an actuation mechanism coupled to the adjustable tab.

A further embodiment of any of the foregoing embodiments may additionally and/or alternatively include the lift van crate further comprising a gap space formed by the feet between the lid and the base, the gap space configured to facilitate lifting the nested lift van crate.

A further embodiment of any of the foregoing embodiments may additionally and/or alternatively include each of the base, the first long wall, the second long wall, the first short wall, the second short wall and the lid are configured stackable.

A further embodiment of any of the foregoing embodiments may additionally and/or alternatively include each of the base, the first long wall, the second long wall, the first short wall, the second short wall and the lid are configured to be assembled and disassembled.

A further embodiment of any of the foregoing embodiments may additionally and/or alternatively include the lift van crate further comprising a joint formed between the tabbed edges and the receiver.

A further embodiment of any of the foregoing embodiments may additionally and/or alternatively include the joint is watertight.

Other details of the lift van crate are set forth in the following detailed description and the accompanying drawings wherein like reference numerals depict like elements.

DETAILED DESCRIPTION

Figure 1:
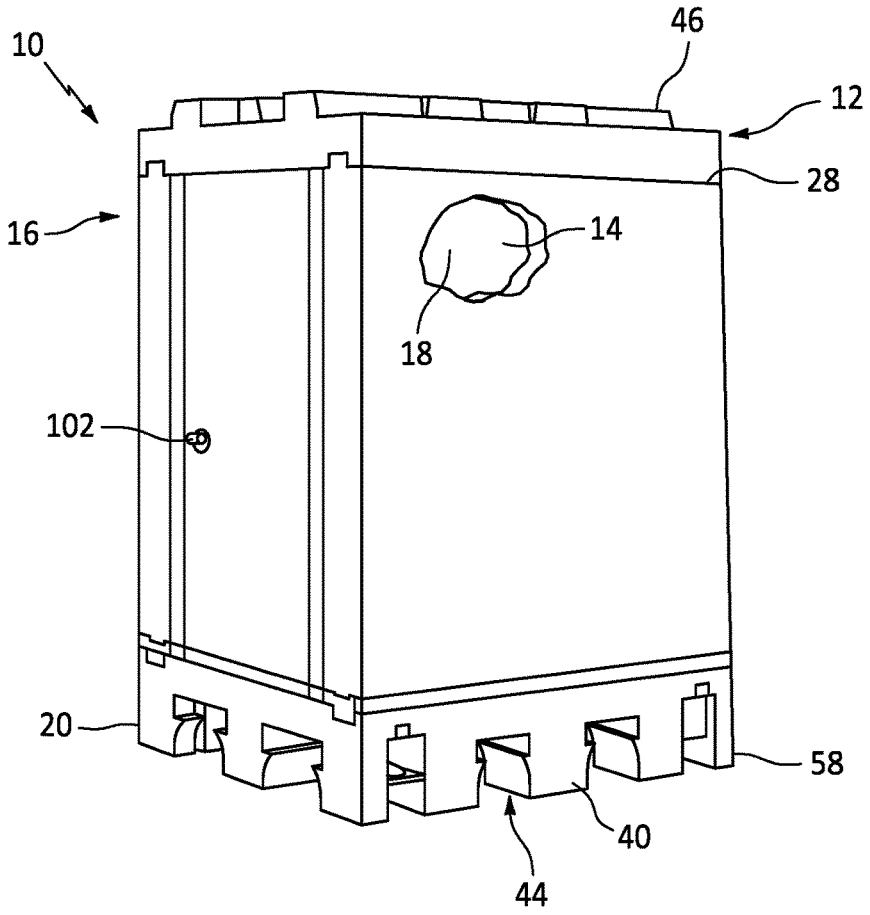
FIG. 1 is an isometric view of an exemplary lift van crate.
Figure 2:
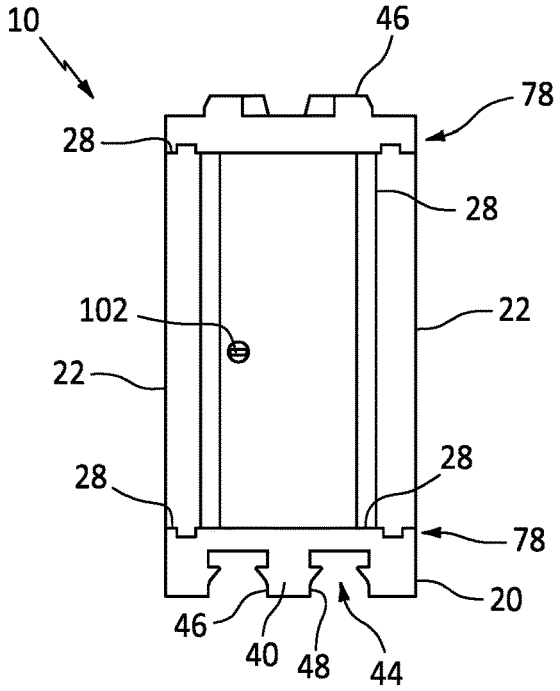
FIG. 2 is a front view of the exemplary lift van crate.

FIGS. 1 and 2 illustrate an assembled exemplary lift van crate 10. The lift van crate 10 comprises an assembly of panels 12 that define an interior 14 and an exterior 16. The panels 12 interlock to form a rectilinear compartment 18 that is configured to contain items (not shown) prepared for moving from one location to another location. In an exemplary embodiment, the lift van crate 10 can have exterior dimensions of 4 feet wide by 7 feet long by 7 feet tall.

The panels 12 include a base or bottom panel 20. The base 20 supports four panels 12, two long walls 22 and two short walls 24. A lid 26 is another panel 12 supported by each of the two long walls 22 and two short walls 24. The lid 26 attaches to the long walls 22 and short walls 24 opposite from the base 20. The long walls 22 attach at locations opposite each other relative to the compartment 18. The short walls 24 attach opposite each other relative to the compartment 18. The two long walls 22 can have the same thickness, length and width dimensions. The two short walls 24 can have the same thickness, length and width dimensions. In an exemplary embodiment, the dimensions can be tailored to meet structural design criteria, for example the long walls 22 can be bifurcated for ease of manufacture. The panels 12 interlock with each other at respective joints or contact areas 28 for repeatable assembly and disassembly.

Figure 3:
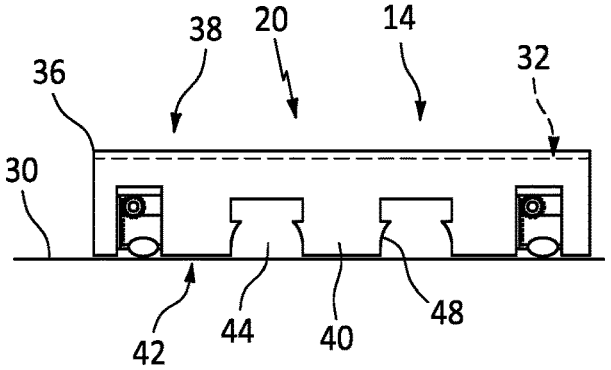
FIG. 3 is a long side view of an exemplary base of the exemplary lift van crate.
Figure 4:
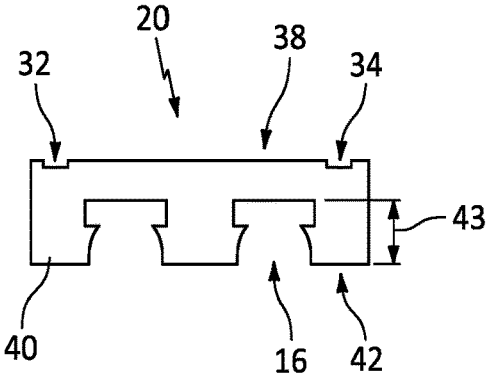
FIG. 4 is a short side view of an exemplary base of the exemplary lift van crate.
Figure 5:
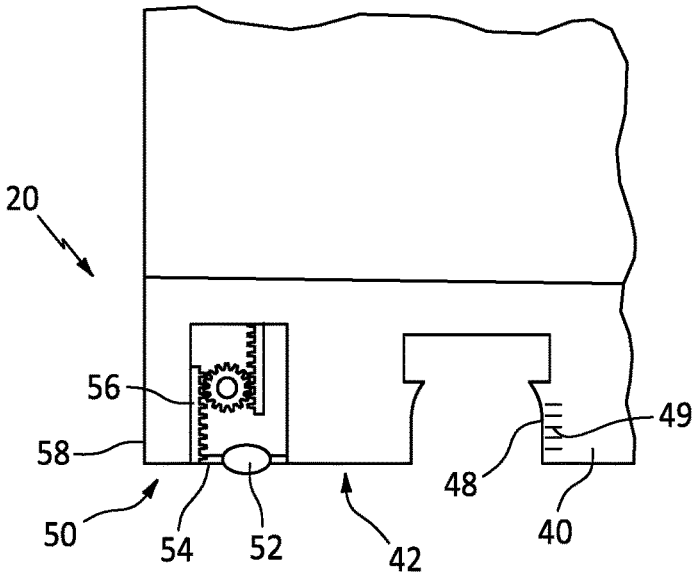
FIG. 5 is a schematic of an exemplary bearing feature within the base.

Referring also to FIGS. 3 to 5, details of the base 20 can be seen. The base 20 is configured in a rectangular shape. The base 20 is configured to rest on a support surface 30 such as the floor/ground, the lid 26 of another crate 10 and the like. The base 20 includes multiple receivers 32 shaped as channels or grooves 34 proximate to a periphery 36 of a base interior face 38. The receivers 32 are configured to receive and support a portion of the respective long wall 22 and short wall 24 being supported by the base 20 at the receivers 32. The receivers 32 can be configured as a continuous channel/groove 34 or intermittent channels/grooves 34 or multiple channels/grooves 34 formed in the interior face 38.

The base 20 can include multiple feet 40 on an exterior face 42 opposite the interior face 38. The feet 40 can be formed as individual extensions that project outwardly from the base 20 opposite the interior face 38. In an exemplary embodiment, the feet 40 can be formed from channels 44 extending along the exterior face 42 with a depth dimension 43. The feet 40 are configured to interlock and nest with complementary ridges 46 formed in the lid 26. The depth dimension 43 is configured to be sufficiently long enough to create a gap or space 45 sufficient to receive the tines/forks of a forklift (not shown) even when the base 20 is stacked on top of the lid 26 of another crate 10 (see FIG. 15). The feet 40 are also configured to receive the tines/forks of a forklift (not shown) to be insertable within the channels 44 between the feet 40 for lifting the crate 10.

In an exemplary embodiment, the feet 40 can include flared or shaped surfaces 48. The technical advantage of the flared surfaces 48 is that the flared surfaces 48 are configured to gradually guide the tines of a forklift to enable less blunt impact and avoid damage to the feet 40. The flared surfaces 48 can be bell-mouth shaped with a wider opening at the exterior and a gradual slope toward the channel 44 between the feet 40. In an exemplary embodiment, the region near the flared surfaces 48 can include visual indicators 49, such as bold colors and/or contrasting color and/or luminescence that is configured to provide a visual indication of the location of the channel cavity 44 for receiving the tine/fork of the forklift. The visual indicator 49 also provides the technical advantage of preventing unnecessary impact and resulting damage to the feet 40.

The base 20 can include a bearing feature 50, as seen in more detail at FIG. 5. The bearing feature 50 can include a ball bearing 52 housed within a bearing mount 54. The bearing mount 54 can be retractable, so as to retract the bearing 52 from the exterior face 42. It is contemplated that the bearing feature 50 can include ball bearings, roller bearings and the like. The bearing mount 54 can include a rack and pinion 56 configuration. As the pinion is rotated the gear teeth translate the rack in a linear motion to move the bearing mount 54 inward and outward. In other exemplary embodiments a spring and latch mechanism and the like can be utilized for the bearing mount 54 to extend and retract the bearing feature 50. The spring can bias the bearing mount 54 in extension, so that the ball bearing 52 can contact the support surface 32. A latch mechanism can be actuated to compress the spring to retract the ball bearing 52. The bearing feature 50 can be mounted within some of the feet 40, proximate each corner of the base 20 and/or other locations that provide adequate support and locomotion for the crate 10. The bearing feature 50 provides the technical advantage that allows for transporting the lift van crate 10 directly on the support surface 30 without the need to be lifted by a forklift.

Figure 6:
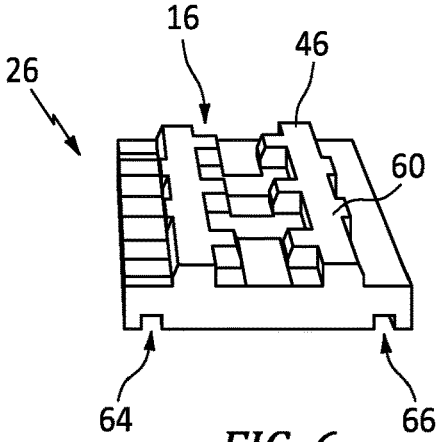
FIG. 6 is an isometric view of the exterior of an exemplary lid of the exemplary lift van crate.
Figure 7:
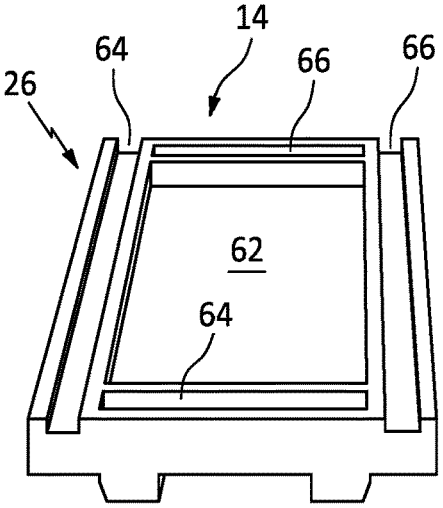
FIG. 7 is an isometric view of the interior of the exemplary lid.

Referring also to FIGS. 6 and 7, the exemplary lid 26 is shown. The lid 26 is configured in a rectangular shape. The lid 26 includes a lid exterior face 60 and a lid interior face 62 opposite the lid exterior face 60. The lid exterior face 60 is configured to be facing the exterior 16 of the crate 10 when assembled. The lid interior face 62 is configured to be facing the crate interior 14 when assembled. The lid exterior face 60 can include the ridges 46 that can facilitate nesting with a complimentary channel 44 of the exterior face 42 of a base 20 being mounted on top of the lid 26 (see FIGS. 15 and 16). On the interior face 62 of the lid 26, lid receivers 64 are provided. The lid receiver 64 can be configured to receive and support a portion of the respective long wall 22 and short wall 24 being supported by the lid 26 at the lid receivers 64. The lid receivers 64 can be configured as a continuous channel/groove 66 or intermittent channels/grooves 66 or multiple channels/grooves 66 formed in the lid interior face 62.

Figure 9:
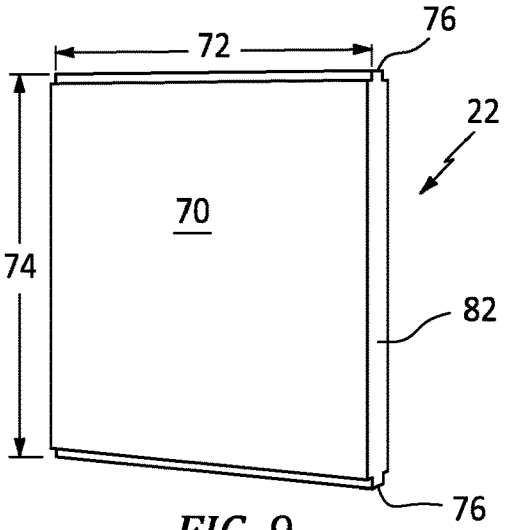
FIG. 9 is an isometric view of an exterior of an exemplary long wall.
Figure 8:
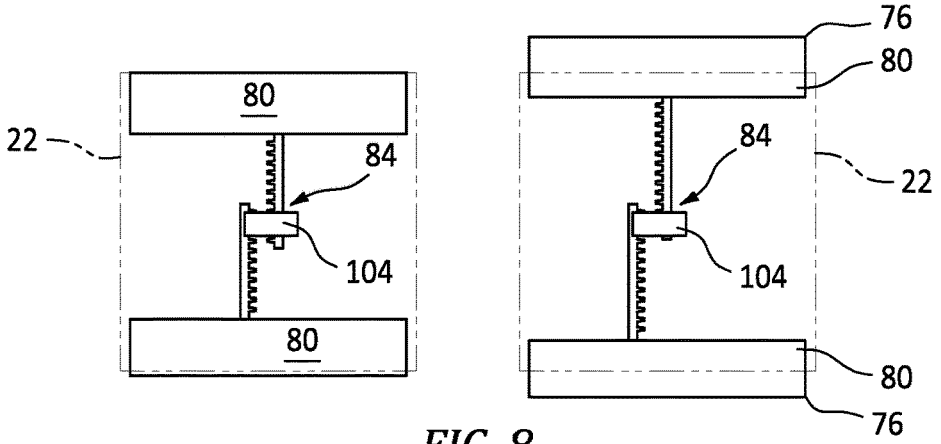
FIG. 8 is a schematic of an exemplary long wall with internal mechanical details.
Figure 10:
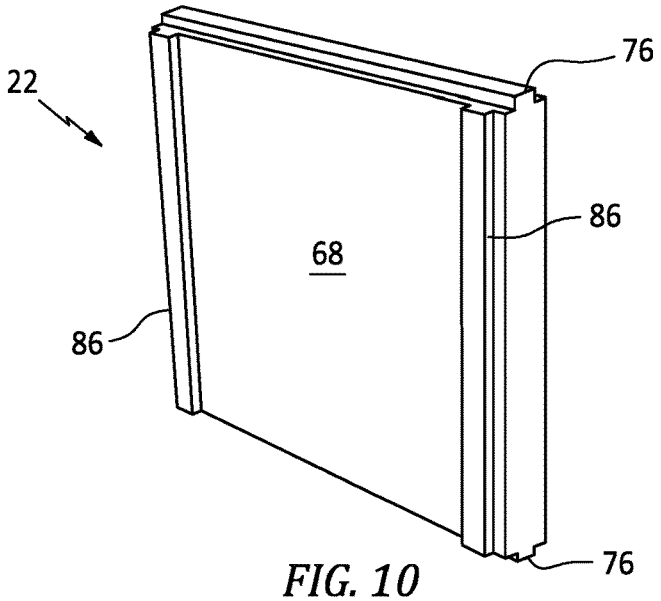
FIG. 10 is an isometric view of an interior of an exemplary long wall.

Referring also to FIGS. 8, 9 and 10, the exemplary long wall 22 is illustrated. The long wall 22 is configured in a rectangular shape. The long wall 22 incudes a long wall interior face 68 and a long wall exterior face 70 opposite the long wall interior face 68. The long wall 22 includes a wall length 72 and a wall height 74. In an exemplary embodiment the long wall 22 wall length 72 and wall height 74 have equal dimensions. The long wall 22 can be divided into two portions for ease of manufacture with similar features. The long wall 22 includes first and second tabbed edges 76 opposite each other. In an exemplary embodiment, the tabbed edges 76 interface with the base 20 receiver 32 and the lid 26 receiver 64. In an exemplary embodiment, the tabbed edge 76 can have a rectangular cross section that mates within a rectangular cross section of the lid receiver 64 and the base receiver 32. The tabbed edge 76 and receiver 32, 64, can be a tongue and groove style joint 78 as shown in FIGS. 1, 2, 14, 15 and 17. In an exemplary embodiment a ship lap joint arrangement is contemplated.

In an exemplary embodiment, the long wall 22 can include adjustable tabs 80 as part of the tabbed edges 76 (as shown in FIG. 8). The adjustable tabs 80 can be translated to extend or contract relative to a perimeter 82 of the long wall 22. Particularly, the adjustable tabs 80 can increase the height 74 dimension of the long wall 22 in order to be inserted into or retracted from the receivers 32, 66 of the base 20 and lid 26 respectfully.

The adjustable tabs 80 can be actuated with an actuation mechanism 84. The actuation mechanism 84 can include a rack and pinion mechanism, a worm gear drive mechanism, a sliding slot latch mechanism and the like.

The long wall 22 can include long wall interior tabs 86 configured to be insertable into short wall receivers 88 (shown at FIGS. 13, 14) of the short wall 24 configured to receive the long wall interior tabs 86.

Figure 11:
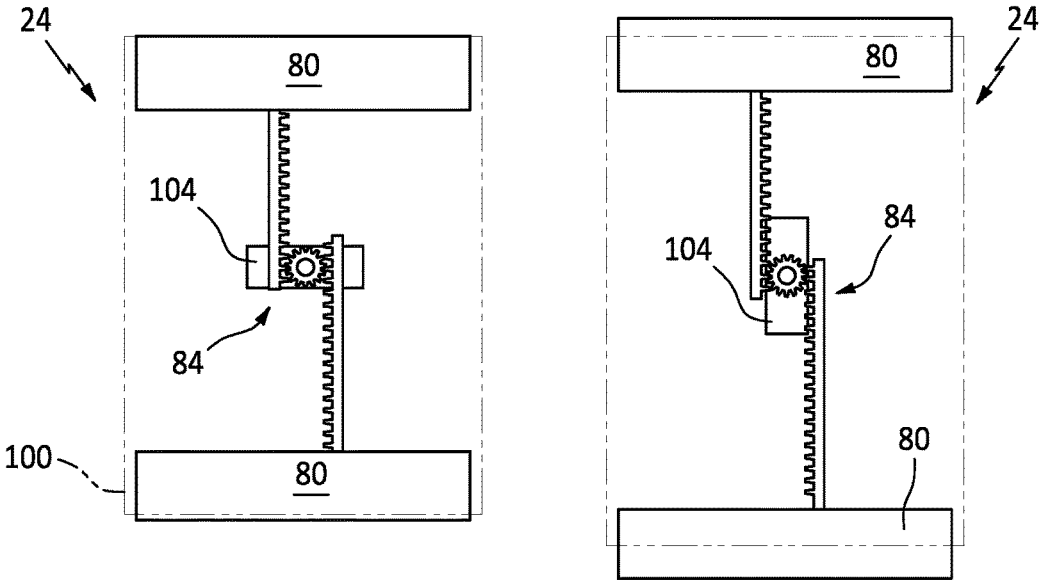
FIG. 11 is a schematic of an exemplary short wall with internal mechanical details.
Figure 12:
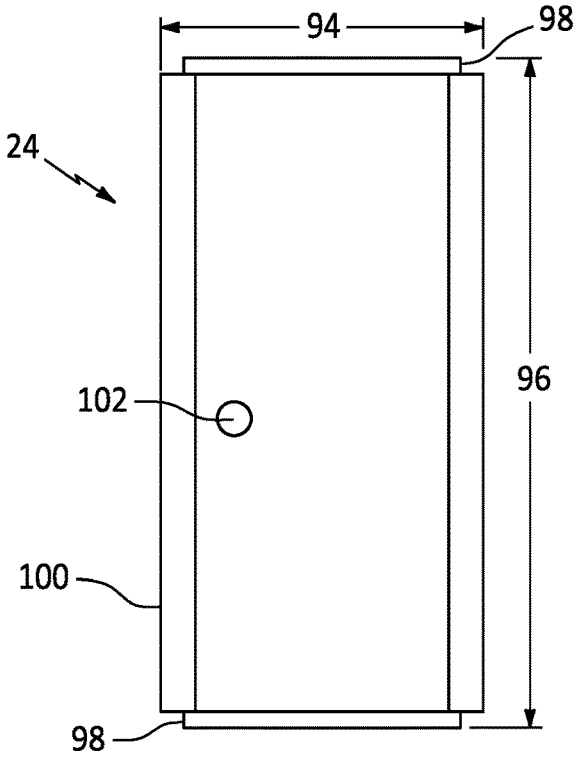
FIG. 12 is a front view of an exemplary short wall.
Figure 13:
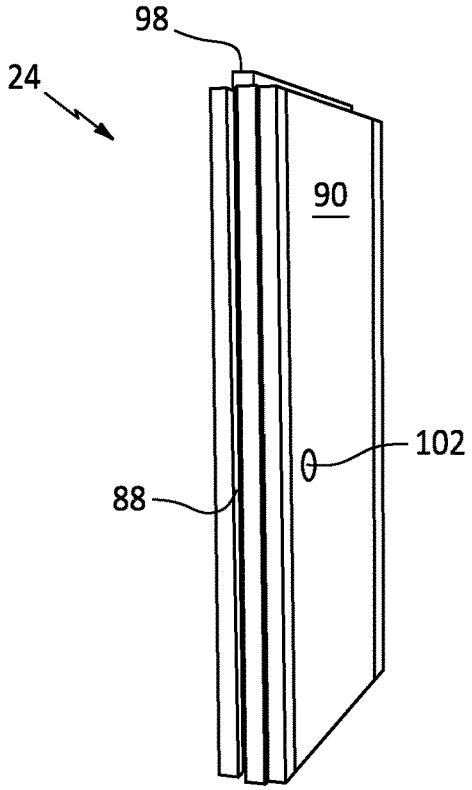
FIG. 13 is a side view of an exemplary short wall.
Figure 14:
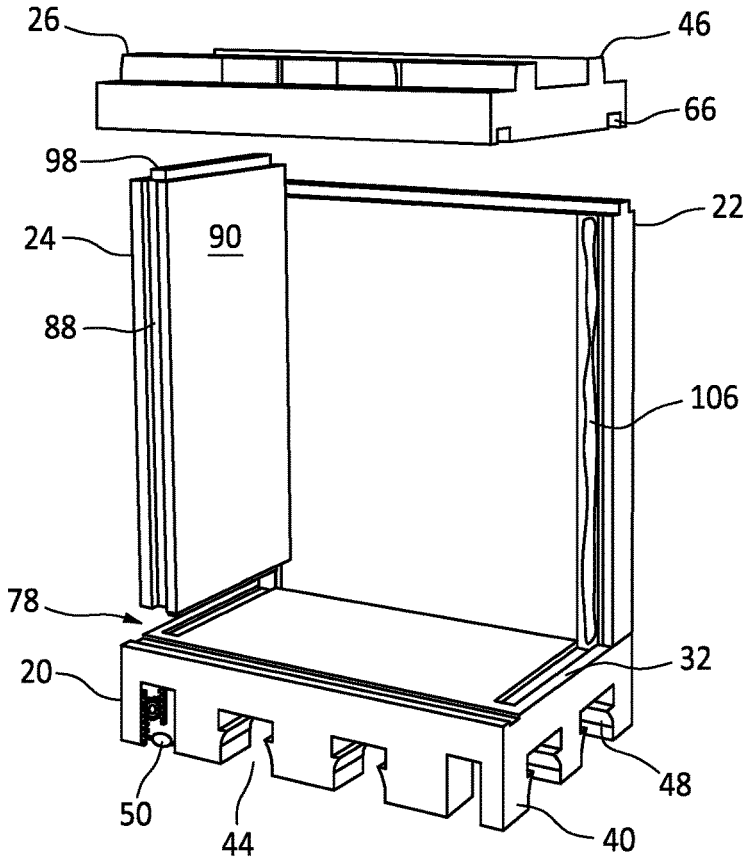
FIG. 14 is an isometric view of a partial assembly of the exemplary lift van crate.

Referring also to FIGS. 11, 12 and 13, the exemplary short wall 24 is illustrated. The short wall 24 is configured in a rectangular shape. The short wall 24 incudes a short wall interior face 90 and a short wall exterior face 92 opposite the short wall interior face 90. The short wall 24 includes a wall length 94 and a wall height 96. In an exemplary embodiment the short wall 24 wall length 94 and wall height 96 have unequal dimensions. The short wall 24 includes first and second tabbed edges 98 opposite each other. In an exemplary embodiment, the tabbed edges 98 interface with the base 20 receiver 32 and the lid 26 receiver 64. In an exemplary embodiment, the tabbed edge 98 can have a rectangular cross section that mates within the rectangular cross section of the lid receiver 64 and the base receiver 32. The tabbed edge 98 and receiver 32, 64, can be a tongue and groove style joint, 78 as shown in FIG. 14. A ship lap style joint is contemplated.

In an exemplary embodiment, the short wall 24 can include adjustable tabs 80 as part of the tabbed edges 76 (as shown in FIG. 8). The adjustable tabs 80 can be translated to extend or contract relative to a perimeter 100 of the short wall 24. Particularly, the adjustable tabs 80 can increase the height 96 dimension of the short wall 24 in order to be inserted into or retracted from the receivers 32, 66 of the base 20 and lid 26 respectfully.

The adjustable tabs 80 can be actuated with an actuation mechanism 84. The actuation mechanism 84 can include a rack and pinion mechanism, a worm gear drive mechanism, a sliding slot latch mechanism and the like. Handles 104 are provided with the actuation mechanism 84 to allow for manual actuation of the actuation mechanism 84.

The short wall 24 can include a hand hold 102 to facilitate grasping the short wall 24. The hand hold 102 can be an indentation, cavity, slot, and the like.

Referring also to FIGS. 14 to 17, the base 20, lid 26, long wall 22 and short walls 24 are configured to be assembled and disassembled. The base 20 and lid 26 include receivers 32, 64 that are configured to accept the tabbed edges 76, 98 and/or adjustable tabs 80 to form the joints 78. The depth and width of the receivers 32, 64 can correlate with the height and width of the tabbed edges 76, 98, and/or adjustable tabs 80. After assembly, the lift van crate 10 includes a sealed, watertight or waterproof boundary to protect the interior 14 from unwanted moisture and/or contaminants. In an exemplary embodiment, sealing material 106 can be provided to enhance the joints 78 in order to seal the joints 78 to prevent ingress of materials.

Figure 15:
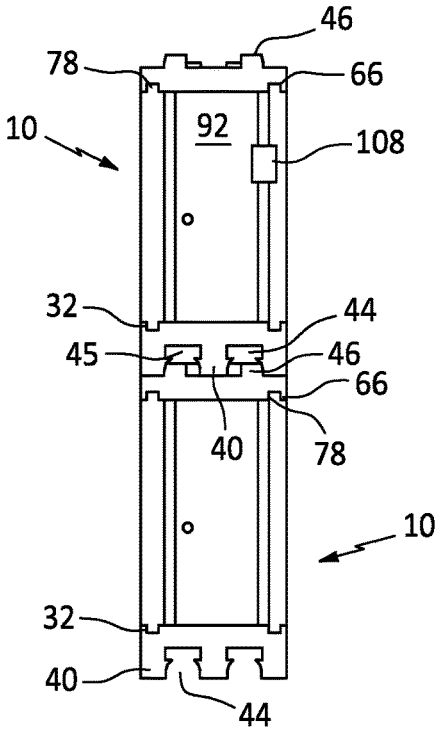
FIG. 15 is a side view of exemplary lift van crates stacked.
Figure 16:
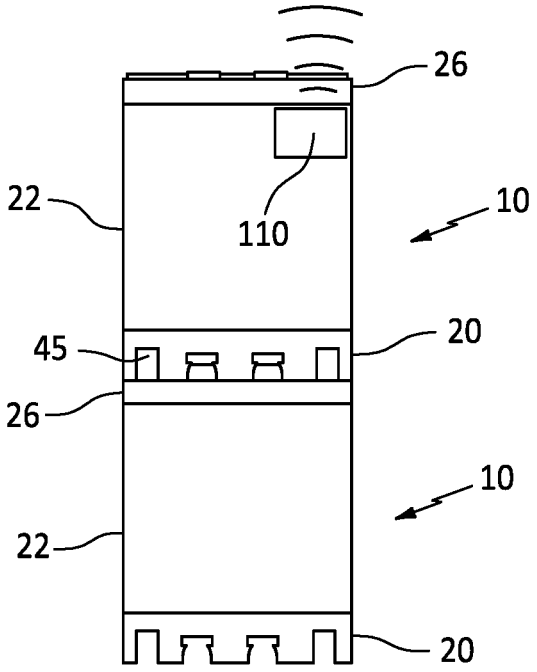
FIG. 16 is a side view of exemplary lift van crates stacked.

As seen in FIGS. 15 and 16 the lift van crate 10 can be stacked and nested such that the lid 26 of the lower crate 10 can interlock with the base 20 of the upper crate 10. The features, channels 44, on the exterior face 42 of the base 20, and ridges 46 on the exterior face 60 of the lid 26 allows for the nesting to enable stacking capability of the crates 10. The nested crates 10 are also configured to allow for a forklift to pick the upper crate 10, since there is sufficient gap space 45 between the lid 26 and adjacent base 20.

The lift van crates 10 can be enhanced by use of hardware 108, such as, clamps, hinges, locks, magnetic clamps, fasteners and the like adjacent the joints 78 to secure the various lid 26, base 20, long wall 22 and short wall 24 assembly/disassembly.

Figure 17:
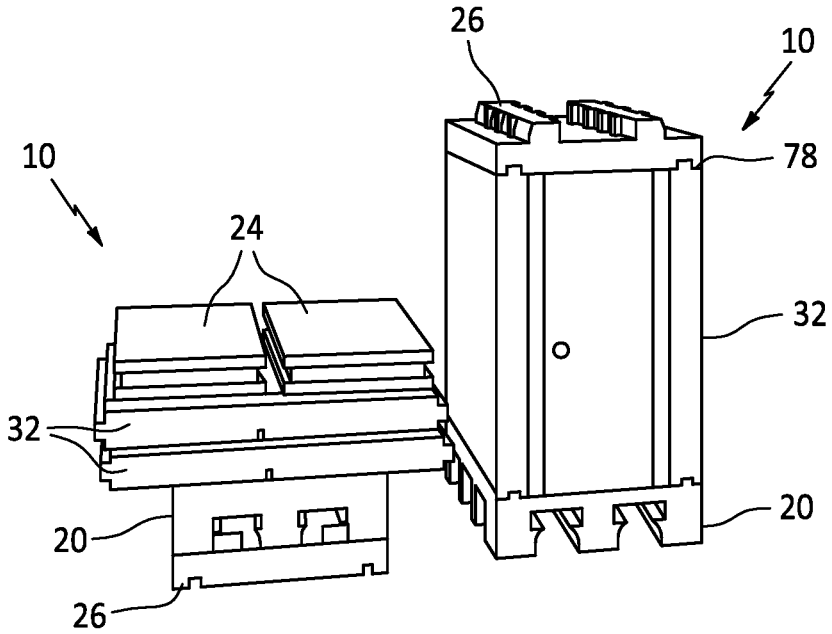
FIG. 17 is an isometric view of exemplary lift van crates in assembled and disassembled form.

The lift van crate 10 is configured to be disassembled and stored in a flat configuration as seen in FIG. 17. The capacity to break down the crate 10 and store flat takes up less storage space in a warehouse or transport vehicle. The lift van crate 10 components are configured as interchangeable with similarly sized crates 10. Thus, replacement of components is possible without the need to replace an entire crate 10. The materials of construction of the crate 10 can include recycled high-density polyethylene (HDPE) resin. A polyurethane foam material can be filled inside the molded HDPE shell of the components, such as the base 20, long wall 22, short wall 24 and lid 26. This material is waterproof, insect proof, and weather resistant. The lift van crate 10 components can be washed with common cleaners and withstand pressure washing. This material choice also provides the advantage of not requiring an ISPM-15 stamp for international shipping. Additional materials of choice can include nylon; plastisol; polycarbonate; elastomer; ethylene vinyl acetate; polyurethane; polyvinyl chloride; polypropylene; polyethylene terephthalate (PETE or PET); high density polyethylene (HDPE); polyvinyl chloride (P or PVC); low-density polyethylene (LDPE); polypropylene (PP); polystyrene (PS); miscellaneous plastics; and the like.

The lift van crate 20 can include a tracker device 110 coupled to the crate 10. The tracker device 110 can include a unique serial number that identifies each unique crate 10. The tracker device 110 enables one to track the crate 10 throughout the life cycle of the crate 10. The tracker device 110 also allows for tracking systems to be utilized to better inform shipping companies of location and movement of the crates 10.

There has been provided a lift van crate. While the lift van crate has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A lift van crate comprising:

a base having an interior face and an exterior face opposite said interior face, at least one receiver formed in said interior face, wherein said base includes at least one channel formed in said exterior face and feet formed in said exterior face adjacent said at least one channel, said feet comprise at least one flared surface with a bell-mouth shape having a wider opening at the exterior and a gradual slope toward the channel between the feet;

a first long wall having tabbed edges and a second long wall having tabbed edges, said tabbed edges of said first long wall and said tabbed edges of said second long wall each being configured to mount to said at least one receiver of said base adjacent said interior face;

a first short wall having tabbed edges and a second short wall having tabbed edges, said tabbed edges of said first short wall and said tabbed edges of said second short wall each being configured to mount to said at least one receiver of said base adjacent said interior face, said first short wall and said second short wall having short wall receivers configured to receive at least one long wall interior tab of each of said respective adjacent first long wall and second long wall; and a lid having an interior face and an exterior face, at least one lid receiver formed in said lid interior face, said lid configured to mount to each of said first long wall, second long wall, first short wall and said second short wall respectively by insertion of said tabbed edges into said at least one lid receiver, wherein a rectilinear shaped compartment is formed.

2. The lift van crate according to claim 1, further comprising:

a visual indicator in a region near the at least one flared surface, the visual indicator configured to provide a visual indication of a location of the channel.

3. The lift van crate according to claim 1, wherein said feet comprise at least one bearing feature mounted within said feet, the bearing feature including a bearing housed within a bearing mount.

4. The lift van crate according to claim 1, further comprising at least one ridge formed in said exterior surface of said lid, said at least one ridge being insertable into said at least one channel of said base between said feet, wherein said base exterior surface being configured to nest with said lid for stacking said lift van crate onto another lift van crate.

5. The lift van crate according to claim 1, wherein at least one of said first long wall and said second long wall comprise an adjustable tab configured to be retracted and extended relative to a perimeter of the at least one of said first long wall and said second long wall and configured to be inserted into or retracted from the at least one receiver formed in said interior face, or the at least one lid receiver.

6. The lift van crate according to claim 1, wherein at least one of said first short wall and said second short wall comprise an adjustable tab configured to be retracted and extended relative to a perimeter of the at least one of said first short wall and said second short wall and configured to be inserted into or retracted from the at least one receiver formed in said interior face, or the at least one lid receiver.

7. The lift van crate according to claim 6, further comprising an actuation mechanism coupled to said adjustable tab.

8. The lift van crate according to claim 4, further comprising a gap space formed by said feet between said lid and said base, said gap space configured to facilitate lifting said nested lift van crate.

9. The lift van crate according to claim 1, wherein each of said base, said first long wall, said second long wall, said first short wall, said second short wall and said lid are configured stackable.

10. The lift van crate according to claim 1, wherein each of said base, said first long wall, said second long wall, said first short wall, said second short wall and said lid are configured to be assembled and disassembled.

11. The lift van crate according to claim 1, further comprising a joint formed between said tabbed edges and said receiver.

12. The lift van crate according to claim 11, wherein said joint is watertight.

13. A lift van crate comprising:

a base having an interior face and an exterior face opposite said interior face, at least one receiver formed in said interior face, wherein said base includes at least one channel formed in said exterior face and feet formed in said exterior face adjacent said at least one channel, said feet comprise at least one bearing feature mounted within said feet, the bearing feature being selected from the group consisting of a ball bearing and a roller bearing;

a first long wall having tabbed edges and a second long wall having tabbed edges, said tabbed edges of said first long wall and said tabbed edges of said second long wall each being configured to mount to said at least one receiver of said base adjacent said interior face;

a first short wall having tabbed edges and a second short wall having tabbed edges, said tabbed edges of said first short wall and said tabbed edges of said second short wall each being configured to mount to said at least one receiver of said base adjacent said interior face, said first short wall and said second short wall having short wall receivers configured to receive at least one long wall interior tab of each of said respective adjacent first long wall and second long wall; and a lid having an interior face and an exterior face, at least one lid receiver formed in said lid interior face, said lid configured to mount to each of said first long wall, second long wall, first short wall and said second short wall respectively by insertion of said tabbed edges into said at least one lid receiver, wherein a rectilinear shaped compartment is formed.

14. The lift van crate according to claim 13, wherein the bearing mount includes a rack and pinion configuration configured to extend and to retract the bearing feature.

15. The lift van crate according to claim 13, wherein the bearing mount includes a spring and latch mechanism configured to extend and to retract the bearing feature.

16. The lift van crate according to claim 13, wherein the bearing feature is mounted within the feet proximate each corner of the base.

17. A lift van crate comprising:

a base having an interior face and an exterior face opposite said interior face, at least one receiver formed in said interior face;

a first long wall having tabbed edges and a second long wall having tabbed edges, said tabbed edges of said first long wall and said tabbed edges of said second long wall each being configured to mount to said at least one receiver of said base adjacent said interior face;

a first short wall having tabbed edges and a second short wall having tabbed edges, said tabbed edges of said first short wall and said tabbed edges of said second short wall each being configured to mount to said at least one receiver of said base adjacent said interior face, said first short wall and said second short wall having short wall receivers configured to receive at least one long wall interior tab of each of said respective adjacent first long wall and second long wall; wherein at least one of said first long wall, said second long wall, said first short wall and said second short wall comprise an adjustable tab configured to be retracted and extended with an actuation mechanism; and a lid having an interior face and an exterior face, at least one lid receiver formed in said lid interior face, said lid configured to mount to each of said first long wall, second long wall, first short wall and said second short wall respectively by insertion of said tabbed edges into said at least one lid receiver, wherein a rectilinear shaped compartment is formed.

18. The lift van crate according to claim 17, wherein the actuation mechanism is selected from the group consisting of a rack and pinion mechanism, a worm gear drive mechanism and a sliding slot latch mechanism.

19. The lift van crate according to claim 17, wherein the actuation mechanism includes a handle configured for manual actuation of the actuation mechanism.

* * * * *